United States Patent [19]

Binversie et al.

[11] Patent Number: 4,986,773

[45] Date of Patent: Jan. 22, 1991

[54] TRIM ADJUSTMENT ARRANGEMENT FOR MARINE PROPULSION DEVICE

[75] Inventors: Gregory J. Binversie, Grayslake; James E. Macier, Beach Park, both of Ill.

[73] Assignee: Outboard Marine Corproation, Waukegan, Ill.

[21] Appl. No.: 407,108

[22] Filed: Sep. 14, 1989

[51] Int. Cl.[5] ..... B63H 5/12

[52] U.S. Cl. ..... 440/61

[58] Field of Search ..... 440/53, 54, 55, 56, 440/57, 58, 59, 60, 61, 62, 63; 248/640, 641, 642, 643

[56] References Cited

U.S. PATENT DOCUMENTS

| | | | |
|---|---|---|---|
| 2,953,335 | 9/1960 | Kiekhaefer | 440/61 |
| 2,966,876 | 1/1961 | MacWilliam | 440/61 |
| 3,053,489 | 9/1962 | Robinson et al. | 440/61 |
| 4,306,703 | 12/1981 | Finze | 248/ |
| 4,391,592 | 7/1983 | Hundertmark | 440/ |
| 4,778,414 | 10/1988 | Taguchi | 440/61 |

FOREIGN PATENT DOCUMENTS

| | | | |
|---|---|---|---|
| 2400336 | 8/1974 | Fed. Rep. of Germany | 440/61 |
| 1097 | 1/1985 | Japan | 440/61 |

*Primary Examiner*—Sherman Basinger
*Assistant Examiner*—Stephen P. Avila
*Attorney, Agent, or Firm*—Michael, Best & Friedrich

[57] ABSTRACT

Disclosed herein is a marine propulsion device comprising a transom bracket adapted to be fixed to a boat transom and including a pattern of apertures spaced from an axis extending horizontally through the transom bracket when the transom bracket is boat mounted and including a forwardmost aperture, a thrust pin selectively insertable into any one of the apertures, a swivel bracket connected to the transom bracket for pivotal movement about the axis relative to the transom bracket and including a thrust transmitting surface for engagement with the thrust pin, and a cylinder/piston assembly having a first end connected to the transom bracket and a second end connected to the swivel bracket and extending forwardly of and below the pattern of apertures.

22 Claims, 1 Drawing Sheet

TRIM ADJUSTMENT ARRANGEMENT FOR MARINE PROPULSION DEVICE

BACKGROUND OF THE INVENTION

1. Field of the Invention

The invention relates generally to marine propulsion devices, such as outboard motors and stern drive units. More particularly, the invention relates to arrangements for varying the angular relationship between a transom bracket and a swivel bracket to maximize propulsive thrust and to arrangements for transmitting such thrust.

2. Reference to Prior Art

In the past, as shown in FIG. 1, it was common to provide a single series of angularly spaced thrust pin receiving apertures 2 in each of a pair of horizontally spaced rearwardly extending portions 3 (only one shown) of a transom bracket 4. The series of apertures 2 in each rearwardly extending transom bracket portion 3 extended at a common distance from a tilt axis 5 and generally along the bottom margins of the rearwardly extending transom bracket portions 3 and with the forwardmost of the apertures being located in relatively closely adjacent relation to the boat transom 6. As a consequence, and when using a hydraulic cylinder/piston assembly 7 connected between the transom bracket 4 and a swivel bracket 8 for providing shock protection in the event of the striking of an underwater obstacle, the cylinder/piston assembly 7 was connected at its bottom end to the transom bracket 4 at a location above the series of apertures 2, which location limited the length of the cylinder/piston assembly 7 and, resulted in the use of high cost components to withstand the high working pressures of shorter stroke hydraulic cylinder/piston assemblies.

Attention is directed to the following U.S. Pat. Nos.:

4,306,703, Finze, Dec. 22, 1981.

4,391,592, Hundertmark, July 5, 1983.

SUMMARY OF THE INVENTION

The invention provides a marine propulsion device comprising a transom bracket adapted to be fixed to a boat transom and including means defining a pattern of apertures spaced from an axis extending horizontally through the transom bracket when the transom bracket is boat mounted and including a forwardmost aperture, a thrust pin selectively insertable into any one of the apertures, a swivel bracket connected to the transom bracket for pivotal movement about the axis relative to the transom bracket and including thrust transmission means for engagement with the thrust pin, and a cylinder/piston assembly having a first end connected to the transom bracket and a second end connected to the swivel bracket and extending below the pattern of apertures.

The invention also provides a marine propulsion device comprising a transom bracket adapted to be fixed to a boat transom and including means defining a pattern of apertures spaced from an axis extending horizontally through the transom bracket when the transom bracket is boat mounted and including a forwardmost aperture, a thrust pin selectively insertable into any one of the apertures, a swivel bracket connected to the transom bracket for pivotal movement about the axis relative to the transom bracket and including thrust transmission means for engagement with the thrust pin, and a cylinder/piston assembly having a first end connected to the transom bracket and a second end connected to the swivel bracket and extending forwardly of the pattern of apertures.

The invention also provides a marine propulsion device comprising a transom bracket adapted to be fixed to a boat transom and including an aperture located at a fixed distance from an axis extending horizontally through the transom bracket when the transom bracket is boat-mounted, a swivel bracket connected to the transom bracket for pivotal movement about the axis and relative to the transom bracket and including a thrust transmitting surface located at the fixed distance from the axis, a thrust pin insertable into the aperture, thereby locating the pin in position for engagement with the thrust transmitting surface, and a cylinder/piston assembly having a first end connected to the transom bracket and a second end connected to the swivel bracket and extending below and forwardly of the aperture.

The invention also provides a marine propulsion device comprising a transom bracket adapted to be fixed to a boat transom and including a first series of spaced apertures located at a first distance from an axis extending horizontally through the transom bracket when the transom bracket is boat mounted, and a second series of spaced apertures located at a second distance from the axis different from the first distance, a swivel bracket connected to the transom bracket for pivotal movement about the axis relative to the transom bracket and including a first thrust transmitting surface located at the first distance from the axis, and a second thrust transmitting surface located at the second distance from the axis and spaced angularly about the axis from said first surface, and a thrust pin selectively insertable into any one of the apertures, thereby locating the thrust pin in position for selective engagement with the thrust transmitting surfaces and thereby enabling variations in the angular relation between the transom bracket and the swivel bracket about the axis during thrust transmission.

The invention also provides a marine propulsion device comprising a transom bracket adapted to be fixed to a boat transom and including a lower series of spaced apertures located at a first distance from an axis extending horizontally through the transom bracket when the transom bracket is boat mounted, and an upper series of spaced apertures which is located at a second distance from the axis and more rearwardly than the first series of apertures, which second distance is less than the first distance, and which is at least partially angularly overlapping the first series, which apertures in each of the first and second series are evenly angularly spaced from each other and at least some of the apertures in one of the upper and lower series being angularly located centrally of the apertures in the other of the upper and lower series, a swivel bracket connected to the transom bracket for pivotal movement about the axis relative to the transom bracket and including a first thrust transmitting surface located at the first distance from the axis, and a second thrust transmitting surface located at the second distance from the axis and spaced angularly rearwardly about the axis from the first surface, and a thrust pin selectively insertable into any one of the apertures, thereby locating the thrust pin in position for selective engagement with the thrust transmitting surfaces and thereby enabling variations in the angular relation between the transom bracket and the swivel bracket about the axis during thrust transmission.

Other features and advantages of the invention will become apparent to those skilled in the art upon review of the following detailed description, claims, and drawings.

THE DRAWINGS

Figure 1:
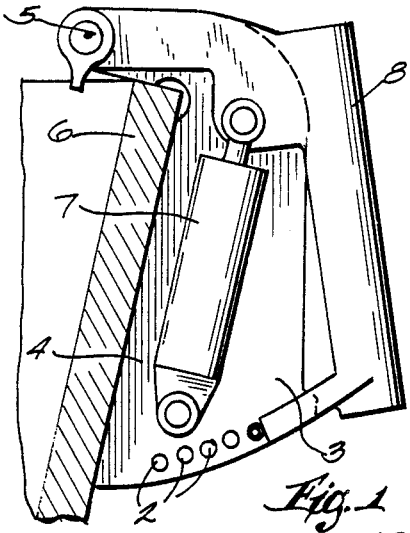
Fig. 1 PRIOR ART
FIG. 1 is a fragmentary view, partially in section, illustrating a portion of a marine propulsion device in accordance with the prior art.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 2:
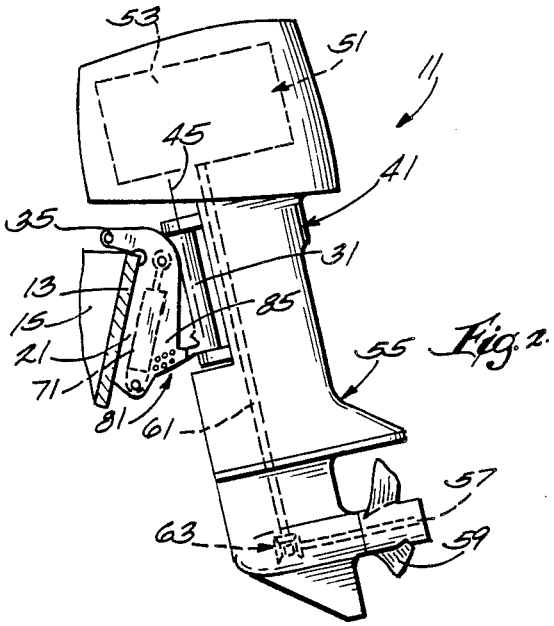
FIG. 2 is an elevational view, partially in section, of a marine propulsion device embodying various of the features of the invention.
Figure 3:
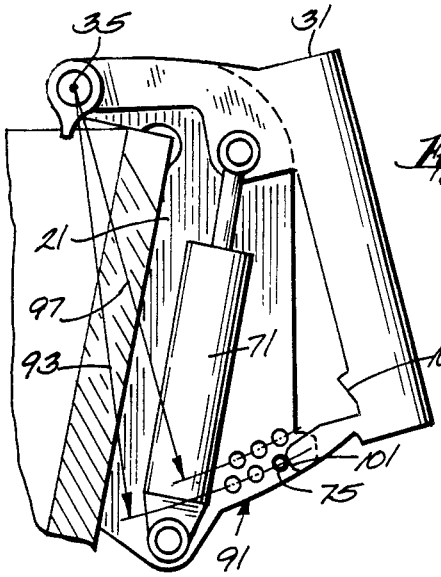
FIG. 3 is an enlarged view, partially in section, of a portion of the marine propulsion device shown in FIG. 2.
Figure 4:
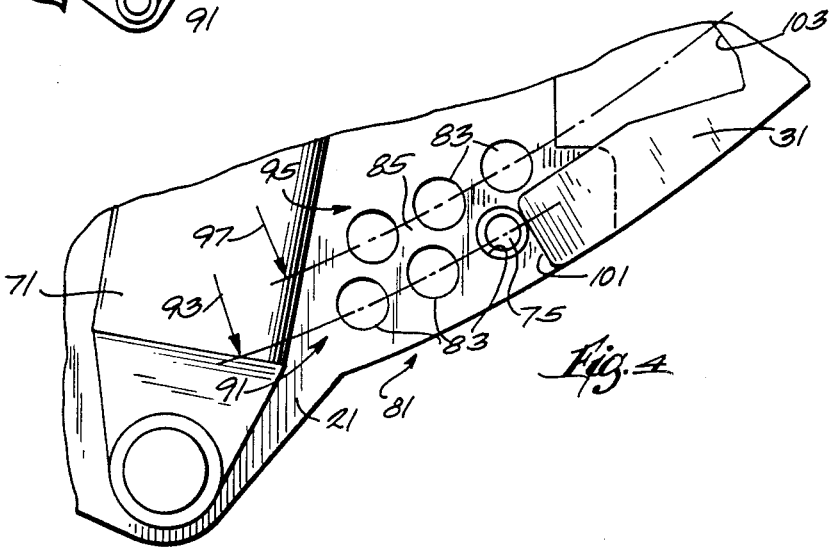
FIG. 4 is a further enlarged view of a portion of the structure shown in FIG. 3.

Shown in FIG. 2 of the drawings is a marine propulsion device which is in the form of an outboard motor 11 adapted to be mounted on a transom 13 of a boat 15. While the invention is disclosed in the form of an outboard motor, it is equally applicable to stern drive units.

As is conventional, the outboard motor 11 includes a transom bracket 21 which is adapted to be fixed to the boat transom 13, a swivel bracket 31 which is connected to the transom bracket 21 for pivotal movement relative thereto about an axis 35 which is generally horizontal when the transom bracket 21 is boat mounted, and a propulsion unit 41 which is connected to the swivel bracket 31 for tilting movement about the horizontal axis 35 in common with the swivel bracket 31 and relative to the transom bracket 21 and for pivotal steering movement relative to the swivel bracket 31 about a generally vertical steering axis 45.

The propulsion unit 41 comprises a power head 51 including an internal combustion engine 53. In addition, the propulsion unit 41 includes a lower unit 55 which supports the power head 51, which is connected to the swivel bracket 31 for steering movement about the steering axis 45, and which supports a propeller shaft 57 which carries a propeller 59 and which is driven by the engine 53 through a drive shaft 61 and transmission 63.

Means are also provided for absorbing shock in the event the lower unit 55 strikes an object in the water. Thus, the outboard motor 11 also includes a hydraulic cylinder/piston assembly 71 which, at its ends, is pivotally connected to the transom bracket 21 and to the swivel bracket 31. The hydraulic cylinder/piston assembly 71 can be a shock absorber, or can alternatively be a tilt cylinder, or can additionally be a tilt cylinder.

In order to permit the utilization of a cylinder/piston assembly which is of greater axial length and therefore, in the case of shock absorbers, which is more capable of effectively absorbing energy in the event of the striking of an underwater obstacle by the lower unit, the outboard motor 11 shown in the drawings includes means located aft of the cylinder/piston assembly 71 and above the lower end thereof for adjustably angularly locating the swivel bracket 31 relative to the transom bracket 21 for thrust transmission therebetween and so as to accommodate variations in the angular disposition of different transoms and to accommodate different loadings within a boat while, at the same time, also enabling disposition of the propeller shaft 57 in a generally horizontal location so as to maximize propulsive conditions.

In the disclosed construction, the means for adjustably angularly locating the swivel bracket 31 relative to the transom bracket 21 for thrust transmission therebetween and thus to the boat transom, includes a thrust pin 75, means on the transom bracket 21 aft of the hydraulic cylinder/piston assembly 71 for affording selective receipt of the thrust pin 75 in any selected one of a pattern 81 of thrust pin receiving apertures 83, and means on the swivel bracket 31 for engaging the thrust pin 75 to transmit thrust thereto which, in turn, is transmitted to the transom bracket 21 by the thrust pin 75.

While the drawings illustrate only one pattern 81 of apertures 83 for receipt of the thrust pin 75, it is to be understood that the transom bracket 21 includes two horizontally spaced rearwardly extending portions 85 (one shown) which are each provided with identical aperture patterns 81, that the thrust pin 75 spans the space between the aperture patterns 81, and that the thrust pin 75 is engaged by the swivel bracket 31 in the area between the horizontally spaced aperture patterns 81.

More particularly, the aperture pattern 81 includes a first or lower series 91 of apertures 83 extending at a common first distance 93 from the horizontal axis 35 and in even angular spacing from one another about the axis 35 and a second or upper series 95 of spaced apertures 83 extending at a common second distance 97 from the horizontal axis 35, which second distance 97 is less than the first distance 95 and which apertures 83 of the second series or upper series 95, are located in the same even angularly spaced relation to each other about the horizontal axis. In the specifically disclosed construction, each of the aperture series 91 and 95 includes three apertures 83 which are angularly evenly spaced from each other and the apertures 83 in the second or upper series 95 are respectively located centrally between adjacent apertures 83 in the other or lower series 91.

The means on the swivel bracket 31 for engaging the thrust pin 75 includes a first or lower thrust transmitting surface 101 located at the first distance 93 from the horizontal axis 35 and a second or upper thrust receiving surface 103 located at the second or lesser distance 95 from the horizontal axis. In addition, the second thrust transmitting surface 103 is spaced rearwardly from the first thrust transmitting surface 101 at an angular distance equal to two and one half times the angular spacing between the apertures 83 in the upper and lower series 91 and 95 and rearwardly from the first thrust transmitting surface 101.

Accordingly, the disclosed arrangement permits six equal angular adjustments of the thrust transmitting location of the swivel bracket 31 relative to the transom bracket 21, and, at the same time, permits utilization of a relatively lengthy cylinder/piston assembly 71 which extends forwardly of the aperture patterns 81.

Various of the features of the invention are set forth in the following claims.

We claim:

1. A marine propulsion device comprising a transom bracket adapted to be fixed to a boat transom and including means defining a pattern of apertures spaced from an axis extending horizontally through said transom bracket when said transom bracket is boat mounted and including a forwardmost aperture, said aperture pattern comprising a first series of spaced apertures located at a first distance from said axis and a second series of spaced apertures located at a second distance from said axis different from said first distance, a thrust pin selectively insertable into any one of said apertures, a swivel bracket connected to said transom bracket for pivotal movement about said axis relative to said transom bracket and including thrust transmission means for engagement with said thrust pin, said thrust transmission means comprising a first thrust transmitting surface located at said first distance from said axis, and a second thrust transmitting surface located at said second distance from said axis and spaced angularly about said axis from said first surface, and a cylinder/piston assembly having a first end connected to said swivel bracket and a second end connected to said transom bracket and extending below and forwardly of said pattern of apertures.

2. A marine propulsion device in accordance with claim 1 wherein said first series is located below said second series and wherein said first and second series overlap angularly with respect to said axis.

3. A marine propulsion device in accordance with claim 1 wherein said second series of apertures extends more rearwardly than said first series of apertures.

4. A marine propulsion device in accordance with claim 1 wherein said first series of apertures extends more forwardly than said second series of apertures.

5. A marine propulsion device in accordance with claim 1 wherein said apertures in each of said first and second series are evenly angularly spaced from each other, and wherein at least some of said apertures in one of said first and second series are angularly located centrally of said apertures in the other of said first and second series.

6. A marine propulsion device in accordance with claim 1 wherein said second series of apertures is located above said first series of apertures, and wherein said second thrust transmitting surface is located above and rearwardly of said first thrust transmitting surface.

7. A marine propulsion device comprising a transom bracket adapted to be fixed to a boat transom and including means defining a pattern of apertures spaced from an axis extending horizontally through said transom bracket when said transom bracket is boat mounted, said aperture pattern comprising a first series of spaced apertures located at a first distance from said axis and a second series of spaced apertures located at a second distance from said axis different from said first distance, a thrust pin selectively insertable into any one of said apertures, and a swivel bracket connected to said transom bracket for pivotal movement about said axis relative to said transom bracket and including thrust transmission means for engagement with said thrust pin, said thrust transmission means comprising a first thrust transmitting surface located at said first distance from said axis, and a second thrust transmitting surface located at said second distance from said axis and spaced angularly about said axis from said first surface.

8. A marine propulsion device in accordance with claim 7 wherein said first series is located below said second series and wherein said first and second series overlap angularly with respect to said axis.

9. A marine propulsion device in accordance with claim 7 wherein said second series of apertures extends more rearwardly than said first series of apertures.

10. A marine propulsion device in accordance with claim 7 wherein said first series of apertures extends more forwardly than said second series of apertures.

11. A marine propulsion device in accordance with claim 7 wherein said apertures in each of said first and second series are evenly angularly spaced from each other, and wherein at least some of said apertures in one of said first and second series are angularly located centrally of said apertures in the other of said first and second series.

12. A marine propulsion device in accordance with claim 7 wherein said second series of apertures is located above said first series of apertures, and wherein said second thrust transmitting surface is located above and rearwardly of said first thrust transmitting surface.

13. A marine propulsion device in accordance with claim 7 and further comprising a cylinder/piston assembly having a first end connected to said swivel bracket and a second end connected to said transom bracket and extending forwardly of said apertures.

14. A marine propulsion device in accordance with claim 7 and further comprising a cylinder/piston assembly having a first end connected to said swivel bracket and a second end connected to said transom bracket and extending below said pattern of apertures.

15. A marine propulsion device comprising a transom bracket adapted to be fixed to a boat transom and including a first series of spaced apertures located at a first distance from an axis extending horizontally through said transom bracket when said transom bracket is boat-mounted, and a second series of spaced apertures located at a second distance from said axis different from said first distance, a swivel bracket connected to said transom bracket for pivotal movement about said axis and relative to said transom bracket and including a first thrust transmitting surface located at said first distance from said axis, and a second thrust transmitting surface located at said second distance from said axis, and a thrust pin selectively insertable into any one of said apertures, thereby locating said pin in position for engagement with one of said thrust transmitting surfaces.

16. A marine propulsion device comprising a transom bracket adapted to be fixed to a boat transom and including a first series of spaced apertures located at a first distance from an axis extending horizontally through said transom bracket when said transom bracket is boat mounted, and a second series of spaced apertures located at a second distance from said axis different from said first distance, a swivel bracket connected to said transom bracket for pivotal movement about said axis relative to said transom bracket and including a first thrust transmitting surface located at said first distance from said axis, and a second thrust transmitting surface located at said second distance from said axis and spaced angularly about said axis from said first surface, and a thrust pin selectively insertable into any one of said apertures, thereby locating said thrust pin in position for selective engagement with said thrust transmitting surfaces and thereby enabling variations in the angular relation between said transom bracket and said swivel bracket about said axis during thrust transmission.

17. A marine propulsion device in accordance with claim 16 wherein said first series is located below said second series and wherein said first and second series overlap angularly with respect to said axis.

18. A marine propulsion device in accordance with claim 16 wherein said second series of apertures extends more rearwardly than said first series of apertures.

19. A marine propulsion device in accordance with claim 16 wherein said first series of apertures extends more forwardly than said second series of apertures.

20. A marine propulsion device in accordance with claim 16 wherein said apertures in each of said first and second series are evenly angularly spaced from each other, and wherein at least some of said first and second apertures in one of said series are angularly located centrally of said apertures in the other of said first and second series.

21. A marine propulsion device in accordance with claim 16 wherein said second series of apertures is located above said first series of apertures, and wherein said second thrust transmitting surface is located above and rearwardly of said first thrust transmitting surface.

22. A marine propulsion device comprising a transom bracket adapted to be fixed to a boat transom and including a lower series of spaced apertures located at a first distance from an axis extending horizontally through said transom bracket when said transom bracket is boat mounted, and an upper series of spaced apertures which is located at a second distance from said axis and more rearwardly than said lower series of apertures, said second distance being less than said first distance, and which is at least partially angularly overlapping said lower series, said apertures in each of said lower and upper series being evenly angularly spaced from each other and at least some of said apertures in one of said upper and lower series being angularly located centrally of said apertures in the other of said upper and lower series, a swivel bracket connected to said transom bracket for pivotal movement about said axis relative to said transom bracket and including a first thrust transmitting surface located at said first distance from said axis, and a second thrust transmitting surface located at said second distance from said axis and spaced angularly rearwardly about said axis from said first surface, and a thrust pin selectively insertable into any one of said apertures, thereby locating said thrust pin in position for selective engagement with said thrust transmitting surfaces and thereby enabling variations in the angular relation between said transom bracket and said swivel bracket about said axis during thrust transmission.

* * * * *